US007032687B2

(12) United States Patent
Rask

(10) Patent No.: US 7,032,687 B2
(45) Date of Patent: Apr. 25, 2006

(54) PERCUSSION DEVICE

(75) Inventor: Thomas Rask, Soderhamn (SE)

(73) Assignee: MK-Produkter Mekanik & Kemi AB, Taby (SE)

( * ) Notice: Subject to any disclaimer, the term of this patent is extended or adjusted under 35 U.S.C. 154(b) by 0 days.

(21) Appl. No.: 10/491,342

(22) PCT Filed: Sep. 23, 2002

(86) PCT No.: PCT/SE02/01710

§ 371 (c)(1),
(2), (4) Date: Apr. 1, 2004

(87) PCT Pub. No.: WO03/028958

PCT Pub. Date: Apr. 10, 2003

(65) Prior Publication Data

US 2004/0206525 A1 Oct. 21, 2004

(30) Foreign Application Priority Data

Oct. 1, 2001 (SE) ..... 0103253

(51) Int. Cl.
*B25D 11/00* (2006.01)

(52) U.S. Cl. ..... 173/211; 173/203

(58) Field of Classification Search ..... 173/211, 173/93.7, 114, 121, 122, 203, 205, 112, 113, 173/128, 124

See application file for complete search history.

(56) References Cited

U.S. PATENT DOCUMENTS

| | | | | |
|---|---|---|---|---|
| 1,511,566 | A | 10/1924 | Kollock | |
| 2,094,185 | A | 9/1937 | Norling | |
| 2,153,883 | A * | 4/1939 | Poster | 175/298 |
| 2,621,614 | A * | 12/1952 | Walling | 74/56 |
| 2,655,921 | A * | 10/1953 | Haboush | 606/84 |
| 2,713,992 | A * | 7/1955 | Snyder | 175/56 |
| 2,749,548 | A * | 6/1956 | Turner | 173/203 |
| 3,149,681 | A * | 9/1964 | Drew | 173/97 |
| 3,363,700 | A | 1/1968 | Bogusch | |
| 4,082,152 | A * | 4/1978 | Whitworth | 173/203 |
| 4,103,747 | A * | 8/1978 | Finney | 173/203 |
| 4,289,041 | A * | 9/1981 | Valdespino | 74/56 |
| 4,744,423 | A * | 5/1988 | Chia-Hsi | 173/90 |
| 5,513,709 | A * | 5/1996 | Fisher | 173/205 |
| 6,138,772 | A * | 10/2000 | Miescher et al. | 173/93.5 |

FOREIGN PATENT DOCUMENTS

| | | |
|---|---|---|
| DE | 551139 | 5/1932 |
| DE | 812900 | 9/1951 |
| GB | 180402 | 5/1922 |
| GB | 2209134 | 5/1989 |

* cited by examiner (Continued)

*Primary Examiner*—Louis K. Huynh
*Assistant Examiner*—Paul Durand
(74) *Attorney, Agent, or Firm*—Young & Thompson

(57) ABSTRACT

Percussion device, includes a housing and two movable bodies, an impact body for an impact pin protruding from the housing, and a balancing body for counterbalancing impact motions of the impact body. The housing includes springs, which constantly strive to bring the bodies towards each other and against the action of which the bodies may be separated axially. The balancing body is rotatable, via a drive spindle connected to a driving source the spindle being mounted in a bearing member, at least one of the bodies including an oblique surface, which, by contact against the other body, transforms the rotary motion of the balancing body into axial motions of the impact body. Rotation of the bearing member is prevented by a helical pressure spring attached to the bearing member and the housing. In this way, tangential vibrations cannot be transferred from the drive spindle to the housing.

2 Claims, 1 Drawing Sheet

PERCUSSION DEVICE

Figure 1:
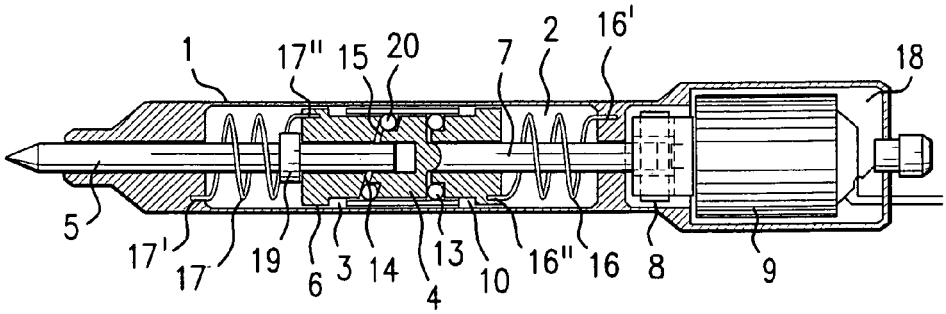

This application is a 371 of PCT/SE02/01710 filed Sep. 23, 2002.

TECHNICAL FIELD OF THE INVENTION

This invention relates to a percussion device comprising a housing and, inside the same, two bodies being movable to and fro each other along a common geometric axis, viz. a first body or impact body for an impact pin protruding from the housing, and a second body or balancing body having the purpose of counterbalancing the impact motions of the impact body so as to anti-vibrate the device in its entirety, and springs which always strive to bring the bodies towards each other and against the action of which said bodies may be separated axially, the balancing body, but not the impact body, being rotatable, and at least one of the bodies including a surface that is oblique in relation to said geometrical axis and, by contact with at least one oblique surface, cog or stud of the other body, arranged to transform the rotary motion of the balancing-body into axial motions of the impact body and thereby also the balancing body, and the balancing body being connected to a driving source via a drive spindle which is rotatably mounted in a bearing member, which is axially movable, but not rotatable in relation to the housing.

PRIOR ART

Percussion devices may be realized in many different practical embodiments and be used for many different technical purposes. In a commonly occurring embodiment, the percussion device is in the form of an engraving pen for stroke engraving of items of, e.g., glass or metal. Other forms of percussion devices may consist of chisel tools, drilling tools or the like.

A percussion device of the type initially mentioned is previously known by U.S. Pat. No. 2,094,185. In this known device, one of the two bearing members of the drive spindle is rigidly connected to the encompassing housing. This implies that tangential forces of the drive spindle are transferred to the housing and cause harmful vibrations therein. In practice, therefore, the known percussion device is not anti-vibrated.

OBJECTS AND FEATURES OF THE INVENTION

The present invention aims at obviating the above-mentioned disadvantage of the percussion device known by U.S. Pat. No. 2,094,185 and at providing an improved percussion device. Thus, a primary object of the invention is to provide a percussion device in which the motions of the drive spindle via the bearings thereof cannot be transferred to the housing and cause vibrations therein. Furthermore, the percussion device should be structurally simple and be driven by an arbitrary driving source, in particular an electric motor, which may operate wherever electric power is available.

BRIEF DESCRIPTION OF THE APPENDED DRAWING

Figure 2:
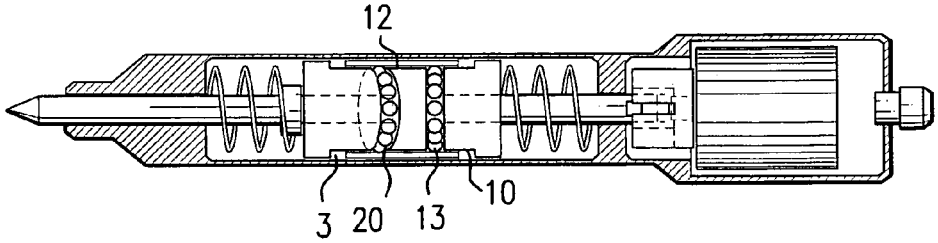
Figure 3:
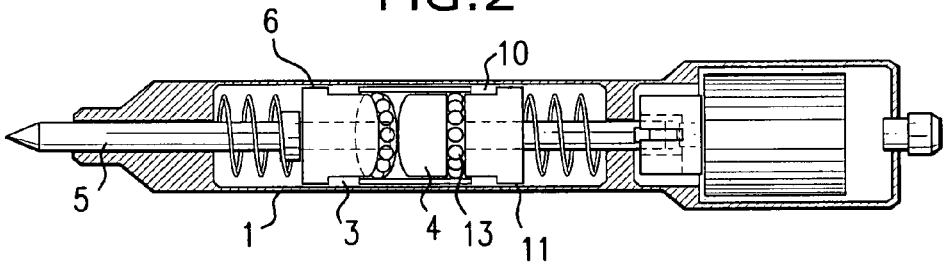
Figure 4:
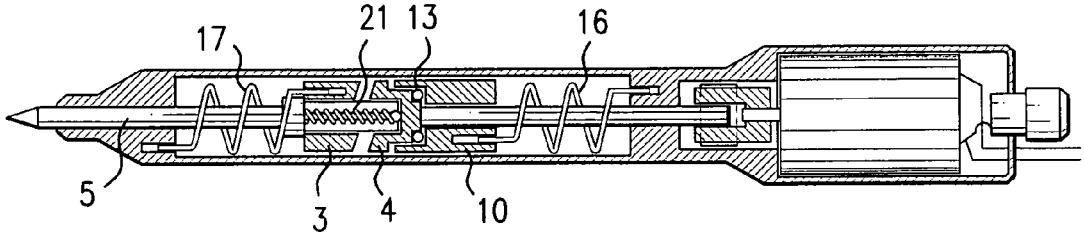
Figure 5:
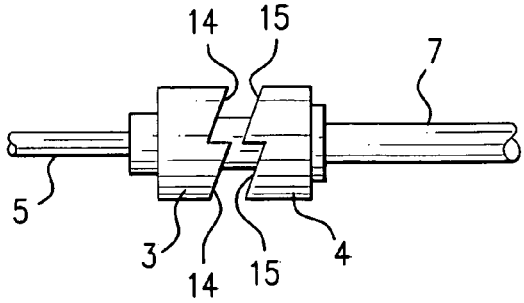

In the drawing:

FIG. 1 is a longitudinal section through a percussion device according to the invention, an impact body and a balancing body being shown in a starting position adjacent to each other, FIG. 2 is a length section turned 90° with the impact and balancing bodies in the same position as in FIG. 1, FIG. 3 is a section showing the impact and balancing bodies maximally separated, FIG. 4 is a longitudinal section through an alternative embodiment of the device according to the invention, and FIG. 5 is an enlarged longitudinal view showing a pair of co-operating impact and balancing bodies action included in the device according to FIG. 4.

DETAILED DESCRIPTION OF PREFERRED EMBODIMENTS OF THE INVENTION

The percussion device shown in FIGS. 1–3 comprises a housing in its entirety denominated 1 and which in the example is of a long narrow, cylindrical primary basic shape. A cavity or chamber 2 in which an impact body 3 is disposed is delimited inside the housing, which impact body interacts with a balancing body 4. An impact pin 5 is connected to a front end of the impact body 3, which pin protrudes a distance from the front end of the housing 1. Advantageously, the impact body 3 is of a cylindrical basic shape and is formed with a front flange 6, the outer diameter of which is slightly smaller than the inner diameter of the chamber 2.

From the rear end of the balancing body 4, a rotatable drive spindle 7 extends, which via a coupling 8 (or gear) is connected to a driving source 9. According to the preferred embodiment of the invention, said driving source consists of an electric motor, which may be mains-operated or battery-powered. The drive spindle 7 is rotatably journalled in relation to a bearing member or collar 10 which like the impact body 3 is of a primary cylindrical basic shape and is formed with a flange 11. Between the two flanges 6, 11, a sleeve 12 extends. Between the balancing body 4 and the bearing member 10, a bearing 13, e.g. a ball bearing, is arranged, which is kept in place by means of the sleeve 12.

The rear end of the impact body 3 is formed with an oblique surface 14, which is arranged to interact with a surface 15, being oblique in the corresponding manner, on the front end of the balancing body 4. In the example according to FIGS. 1–3, said surfaces are shown with an exaggerated angle of inclination for the sake of clarity.

In the device, two comparatively powerful springs 16, 17 are included, which advantageously may consist of helical pressure springs. The first-mentioned spring 16 is, at the rear end 16' thereof, attached to the housing 1, more precisely to a transverse wall between the chamber 2 and a rear space 18 for the motor 9. The front end 16" of the spring 16 is attached to the bearing member 10. The spring 16 enables reciprocal axial motion of the bearing member 10, but prevents the same from rotating.

In an analogous manner, the spring 17 is, at one end thereof, viz. the front end 17', attached to the housing 1, while the rear end 17" is attached to the impact body 3. Thus, like the bearing member 10, the impact body 3 can move axially to and fro, but not rotate.

On the impact pin 5, which advantageously is of a primary cylindrical basic shape, a stop collar 19 is formed against which the plane frontal end surface of the impact body abuts.

In the boundary between the bodies 3, 4 a bearing may be arranged, e.g. a ball bearing 20.

The Function of the Device According to the Invention

In FIGS. 1 and 2, the device is shown in a state, e.g. an idle starting position, in which the impact and balancing bodies 3, 4 are brought close to each other by the action of the springs 16, 17. In this state, the oblique surface 14 of the impact body 3 abuts against the oblique ball bearing 20 of the balancing body 4 (or, alternatively, directly against the surface 15 if the ball bearing is spared). When the drive spindle 7, by means of the motor 9, brings the balancing body 4 to rotate, the wide part of the balancing body 4 will rotate along the oblique surface 14 of the impact body 3 and in that way, after half a revolution maximally distance the bodies 3, 4 from each other to the position shown in FIG. 3. During the subsequent half of revolution, the bodies approach each other again by means of the springs 16, 17, which always strive to bring the bodies together. More precisely, the spring 17 presses the impact body 3 in the backward direction, while the spring 16, via the bearing member 10, urges the balancing body 4 in the forward direction. At the stage when the impact body 3 advances forwardly, the impact pin 5 is carried along by the stop collar 19, the pin by means of the stop collar 19 performing an impact against the item to be machined. Then, when the impact body at the return motion thereof is urged backwards by the spring 17, the impact pin follows by the same being kept urged against the item. More precisely, the device or the tool is in its entirety kept manually urged or pressed against said item.

By driving the rotatable balancing body 4 with a high rotation speed, e.g. 10 000 rpm or more, the impact pin 5 will be set in short, hasty impact motions, which, however, do not result in submitting the tool to vibrations. Thus, the impact motions of the impact body are counterbalanced, in a known way per se, by means of the balancing body 4.

In FIGS. 4 and 5, an alternative embodiment is shown in which a plurality of tangentially spaced, oblique contact surfaces 14, 15 of a limited arc length are formed on the impact body 3 as well as the balancing body 4. In this case, the impact pin 5 will implement a plurality of impact motions for each single revolution of rotation of the balancing body. In practice, the pin may carry out 2–300 impacts/second. In this embodiment, a third spring 21 is arranged between the impact body 3 and the balancing body 4, said spring striving to space apart the bodies 3, 4 from each other. As long as the impact pin 5 is in an unloaded, maximally protruded state (i.e. without being urged against any item), the spring 21 will keep the bodies 3, 4 apart so that the surfaces 14, 15 do not get into contact with each other. In this manner, the balancing body 4 can be kept in rotation by the motor without setting the impact body and the impact pin, respectively, in axial motions.

Feasible Modifications of the Invention

The invention is not merely limited to the embodiments described above and shown in the drawing. Thus, it is feasible to make the oblique contact surfaces of the impact body and the balancing body, respectively, in another way than in the form of plane surfaces. For instance, the contact surfaces may be integral with softly rounded, e.g. sine curved wave formations in one of or both bodies 3, 4. In a feasible embodiment, one or more oblique (plane or rounded) contact surfaces at one of the bodies may interact with a radial stud or cog of the second body.

The invention claimed is:

1. A percussion device comprising:

a housing with first and second bodies inside said housing;

said first and second bodies being movable relative to each other along a common geometric axis, said first body carrying an impact pin protruding from said housing, said second body counterbalancing impact motions of said first body so as to damp vibrations of the device, said second body being rotatable and said first body not being rotatable, and at least one of said first and second bodies having a surface that is oblique to said geometric axis that, by contact with a portion of the other of said first and second bodies, transforms rotary motion of said second body into axial motion of said first and second bodies;

first and second springs that urge said first and second bodies towards each other and against which said first and second bodies are separated axially;

a driving source connected to said second body via a drive spindle that is rotatably mounted in a bearing member, said bearing member being axially movable but not rotatable in relation to said housing;

said second spring being a helical pressure spring with a first end attached to said housing and with a second end attached to said bearing member to urge said bearing member and said second body towards said first body and to prevent rotation of said bearing member; and a third spring between said first body and said second body, said third spring having a strength that keeps said first and second bodies separated while said impact pin is unloaded and maximally protruded.

2. The percussion device of claim 1, wherein said first spring is a helical pressure spring with a first end attached to said housing and with a second end attached to said first body in order to urge said first body towards said second body and to prevent rotation of said first body.

* * * * *